US008549678B2

(12) United States Patent
Neidich et al.

(10) Patent No.: US 8,549,678 B2
(45) Date of Patent: Oct. 8, 2013

(54) ACCELERATED TUB DRAIN

(75) Inventors: Andre J. Neidich, Southlake, TX (US); Robert Buete, Southlake, TX (US); Graham Campbell, Stevenson Ranch, CA (US)

(73) Assignees: Safety Tubs Company, LLC, Piscataway, NJ (US); Balboa Water Group, Tustin, CA (US)

( * ) Notice: Subject to any disclaimer, the term of this patent is extended or adjusted under 35 U.S.C. 154(b) by 1237 days.

(21) Appl. No.: 11/745,289

(22) Filed: May 7, 2007

(65) Prior Publication Data

US 2008/0276368 A1 Nov. 13, 2008
US 2012/0324644 A2 Dec. 27, 2012

(51) Int. Cl.
*E03C 1/12* (2006.01)

(52) U.S. Cl.
USPC ..... 4/679; 4/680; 4/538

(58) Field of Classification Search
USPC ..... 4/541.1–541.6, 679, 680, 682, 686, 4/668, 674, 651
See application file for complete search history.

(56) References Cited

U.S. PATENT DOCUMENTS

| | | | | |
|---|---|---|---|---|
| 210,334 | A * | 11/1878 | Kinsman | 4/682 |
| 1,805,560 | A * | 5/1931 | Barta | 4/651 |
| 4,542,545 | A | 9/1985 | Johnson | |
| 4,586,204 | A * | 5/1986 | Daniels | 4/541.4 |
| 4,716,605 | A * | 1/1988 | Shepherd et al. | 4/541.2 |
| 5,012,535 | A | 5/1991 | Klotzbach | |
| 6,052,844 | A * | 4/2000 | Walsh et al. | 4/541.1 |
| 6,357,060 | B2 | 3/2002 | Gloodt | |
| 8,006,325 | B2 | 8/2011 | Stimpson et al. | |
| 2004/0148693 | A1 | 8/2004 | Anderson | |
| 2013/0025046 | A1 * | 1/2013 | Yu et al. | 4/679 |

FOREIGN PATENT DOCUMENTS

| | | | |
|---|---|---|---|
| EP | 0 898 926 | A1 | 4/1990 |
| JP | 02-115424 | A | 4/1990 |
| JP | 2115424 | A | 4/1990 |
| JP | 11-070053 | A | 3/1999 |
| JP | 11070053 | A | 3/1999 |
| JP | 2002364933 | A | 12/2002 |
| JP | 2005-058381 | A | 3/2005 |
| JP | 2005058381 | A | 3/2005 |

OTHER PUBLICATIONS

Machine Translation for JP2005-58381.*

(Continued)

*Primary Examiner* — Huyen Le
*Assistant Examiner* — Erin Deery
(74) *Attorney, Agent, or Firm* — Flaster/Greenberg P.C.

(57) ABSTRACT

The present invention provides a drain system for a walk-in bathtub. The drain system includes a conventional drain opening in the bottom of the walk-in bathtub and a second drain opening in the side of the foot well of the bathtub. A motorized pump pumps water out of the bathtub through the second drain opening in the foot well. A first drain line provides water outflow from the conventional drain opening to a primary drain pipe. A second drain line provides outflow from the motorized pump to the primary drain pipe, and a third drain line joins the primary drain pipe from an overflow opening near the top of the bathtub. A low water sensor is coupled to the second drain line and motorized pump and deactivates the pump when the water level in the bathtub is equal to or lower than the second drain opening.

44 Claims, 10 Drawing Sheets

(56) References Cited

OTHER PUBLICATIONS

Chinese Office Action dated Jan. 19, 2011, counterpart Chinese Application 200880022159.6.

Response to Chinese Office Action of Jan. 19, 2011 as filed in counterpart Chinese Application 200880022159.6, with English Language translation of response, May 24, 2011.

International Search Report in counterpart PCT Application PCT/US2008/062233, Oct. 22, 2008.

International Preliminary Report on Patentability in counterpart PCT Application No. PCT/US2008/062233, Nov. 10, 2009 (4 pages).

* cited by examiner

ACCELERATED TUB DRAIN

TECHNICAL FIELD

The present invention relates generally to walk-in bathtubs and more specifically to a drain mechanism that allows water to drain from a tub significantly faster than simple gravity draining.

BACKGROUND OF THE INVENTION

Walk-in bathtubs comprise high tub walls with a high built in seat and a side door, allowing the user to walk into the tub from the side and sit down without having to climb down into a low bath tub. FIG. 1 shows a typical example of a walk-in bathtub in accordance with the prior art. Walk-in tubs are particularly suited for individuals who have physical limitations that make it difficult or dangerous to climb into and out of a regular, low bathtub or to stand up in a shower for extended periods of time. Such limitations might include physical disabilities or simply the reduced strength, balance and range of motion that typically occur with advancing age. Walk-in tubs are not only easier to enter and exit than conventional bathtubs they also reduce the chances of slips and falls compared to conventional tubs and showers.

In addition to safety, the ease of entering the tub via the side walk-in door also provides users with independence, allowing them to bathe without the assistance of another person when getting into and out of the tub.

However, because of their depth, walk-in bathtubs hold very large volumes of water. With seat heights approaching 17 inches above the tub floor water volume can reach 70 gallons or more. Typically, such large volumes require up to seven minutes to drain from the tub. This is particularly troublesome in the case of walk-in bathtubs because the occupant cannot open the side door and exit the tub until the water has drained, especially in models in which the side door opens to the inside and is held shut by water pressure.

Therefore it would be desirable to have a mechanism that speeds the drain time of walk-in baths beyond what is possible with simple gravity draining.

SUMMARY OF THE INVENTION

The present invention provides a drain system for a walk-in bathtub. The drain system includes a conventional drain opening in the bottom of the walk-in bathtub and a second drain opening in the side wall of the foot well of the walk-in bathtub. A motorized pump pumps water out of the walk-in bathtub through the second drain opening in the foot well. A first drain line provides water outflow from the conventional drain opening to a primary drain pipe. A second drain line provides water outflow from the motorized pump to the primary drain pipe, and a third drain line joins the primary drain pipe from an overflow opening near the top of the bathtub.

The drain lines from the pump and overflow opening join the primary drain pipe via a Y joint, wherein the drain line from the pump rises higher than the overflow opening and bends downward at approximately 45 degrees to join said Y joint. The bend in the second drain line above the height of the overflow opening prevents backflow. In addition, the drain line from the pump comprises a 1" hose that transitions into a 1.5" pipe at the bend above the overflow, producing an air pocket that breaks the siphon from the tub when the pump is not active.

The drain line from the conventional drain opening in the bottom of the tub also joins the primary drain pipe via a Y joint, which creates a venturi effect that speeds fluid flow through the pipe.

A low water sensor is coupled to the second drain pipe and motorized pump and deactivates the motorized pump when the water level in the walk-in bathtub is equal to or lower than the second drain opening.

With the pump activated, the drain system can produce a water outflow rate of 60 gallons per minute.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1:
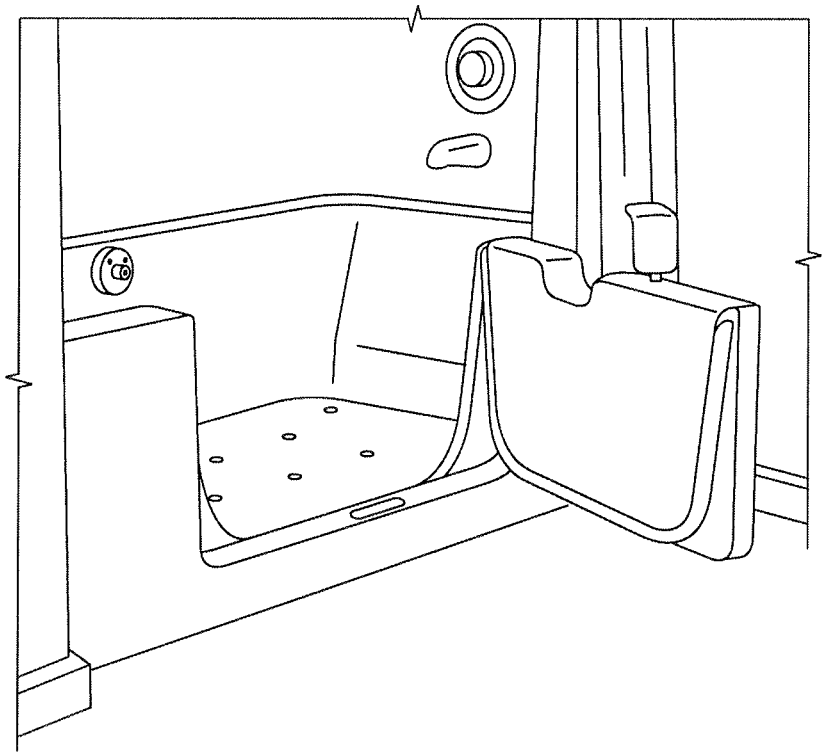
FIG. 1 (Prior Art)
FIG. 1 shows a typical example of a walk-in bathtub in accordance with the prior art.
Figure 2:
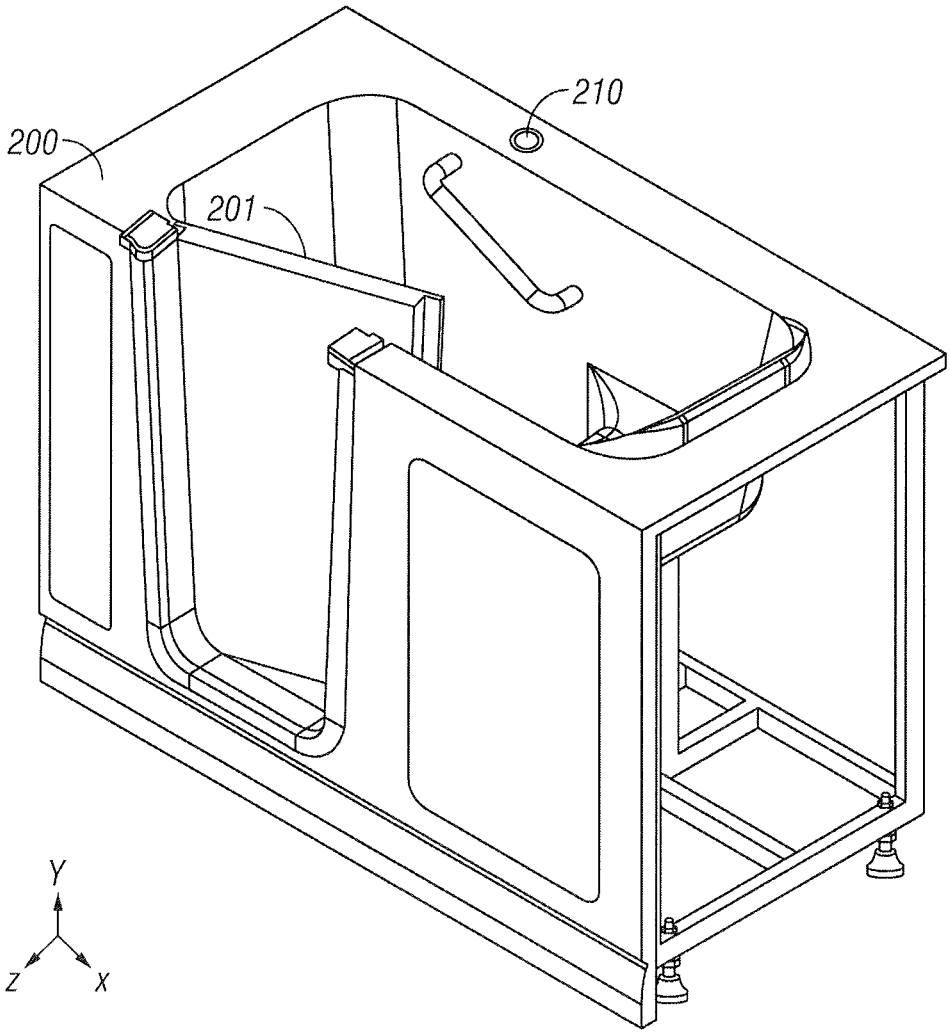
FIG. 2 shows a perspective view of a walk-in bathtub in accordance with a preferred embodiment of the present invention.

FIG. 2 shows a perspective view of a walk-in bathtub in accordance with a preferred embodiment of the present invention. As shown, this embodiment has a side walk-in door 201 that opens to the inside of the tub 200, unlike the door of the tub shown in FIG. 1. Because the side door 201 opens to the inside, the water seal is largely maintained by outward hydrostatic pressure when the tub is filled with water.

Figure 3:
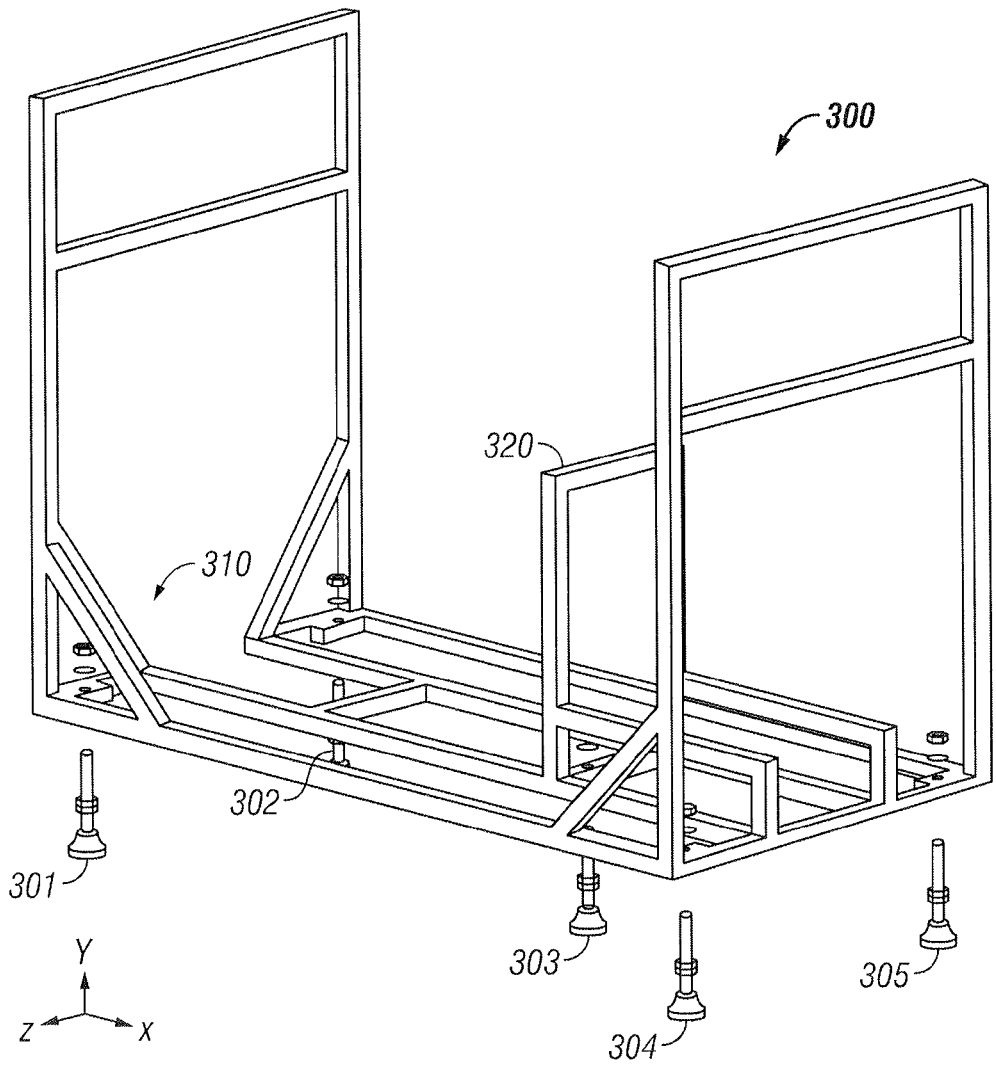
FIG. 3 shows an example of a support frame in accordance with an embodiment of the present invention.

FIG. 3 shows an example of a support frame in accordance with an embodiment of the present invention. The frame 300 is designed to keep the side door from flexing when water is added to the bathtub or due to moisture changes in the bathroom. In addition, its design allows for quick and easy field and manufacturing installation. The cut out 310 on the faucet side makes it easy to install the plumbing. The five adjustable leveling feet 301-305 also enable reverse plumbing, which comprises running the faucets under the tub when the door needs to be on a particular side and the plumbing is on the opposite side. The adjustable feet 301-305 also allow one to drop the tub (if the tub plumbing can be recessed into the floor) to further drop the walk-in threshold making it even easier to get into the tub. In the preferred embodiment, the feet allow the tub to be dropped up to two and half inches. The frame 300 also includes a support 320 for the seat of the tub.

Figure 4:
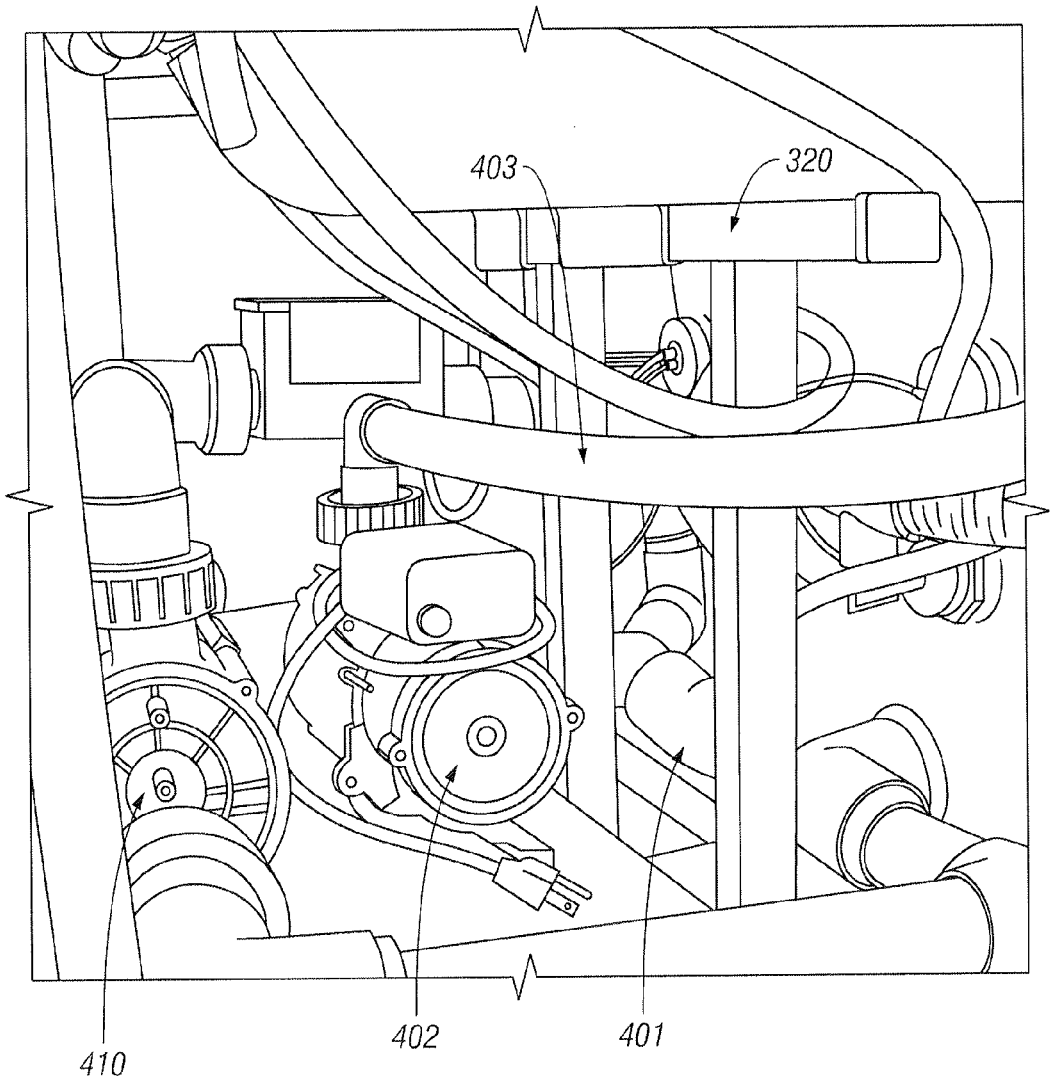
FIG. 4 shows the plumbing of the suction drain in accordance with the present invention.

FIG. 4 shows the plumbing of the suction drain in accordance with the present invention. This equipment is placed under the seat of the walk-in tub; the seat support 320 of the tub frame 300 is shown in FIG. 4. A suction pipe 401 draws water through a dedicated outlet in the foot well of the tub (shown in FIG. 7). In the embodiment depicted in FIG. 4, suction is provided by a dedicated drain pump 402. In the present example, the pump 402 is 5.5 amps and 0.45 hp and a 108 gallons-per-minute (gpm) rated suction produces a fluid flow through the suction pipe 401. However, the size and power of the drain pump 402 and the gpm rate of the suction can vary according to the size of the tube. In an alternate embodiment, the existing whirlpool pump 410 provides the drain suction without the need for a separate drain pump.

Figure 5:
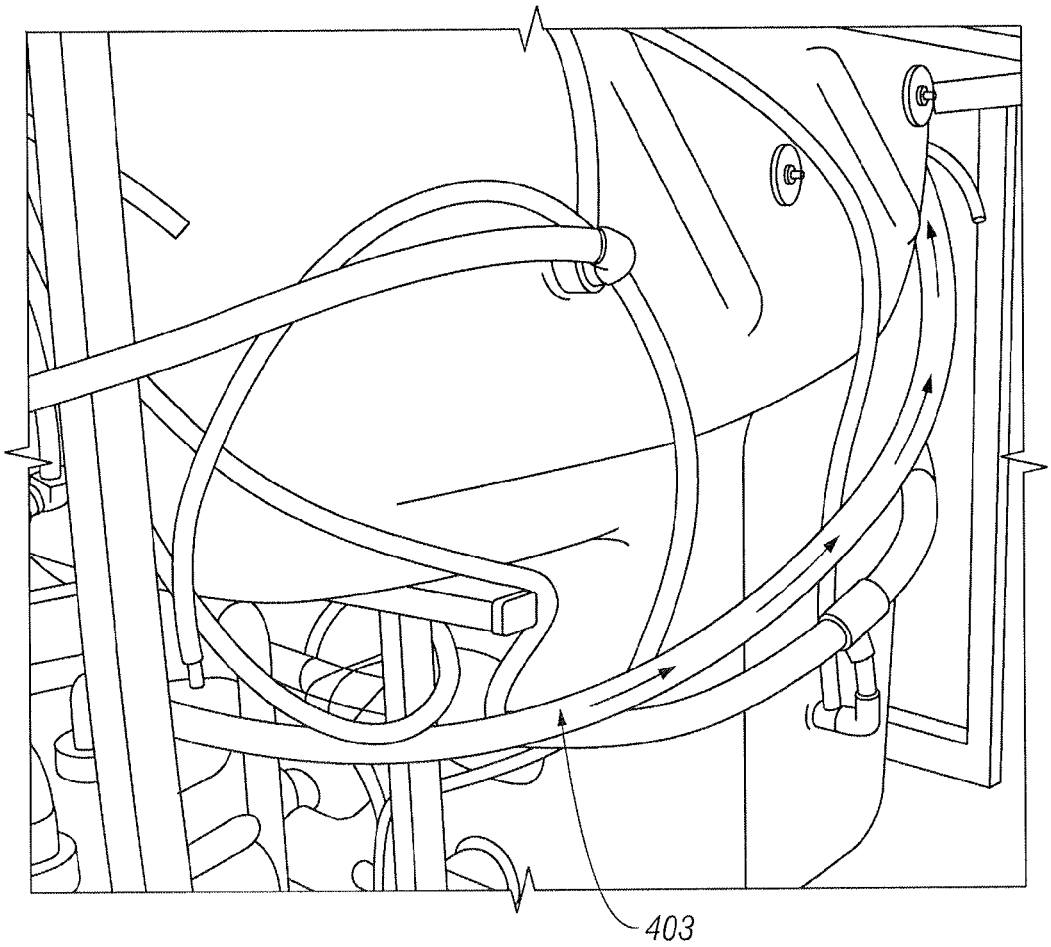
FIG. 5 shows the suction pipe leading from the drain pump to the outlet on the opposite end of the tub.

Also shown in FIG. 4 is a hose 403 leading from the drain pump 402 to the outlet on the opposite end of the tub. The preferred embodiment of the invention uses a 1" hose that goes higher than the overflow opening and into a standard 1.5" pipe to break the siphon when the drain pump is not activated (see FIG. 6A). However, different hose and pipe sizes can be used depending on the size of the tub and desired flow rate. FIG. 5 shows the suction hose 403 running along the back of the tub.

Figure 6A:
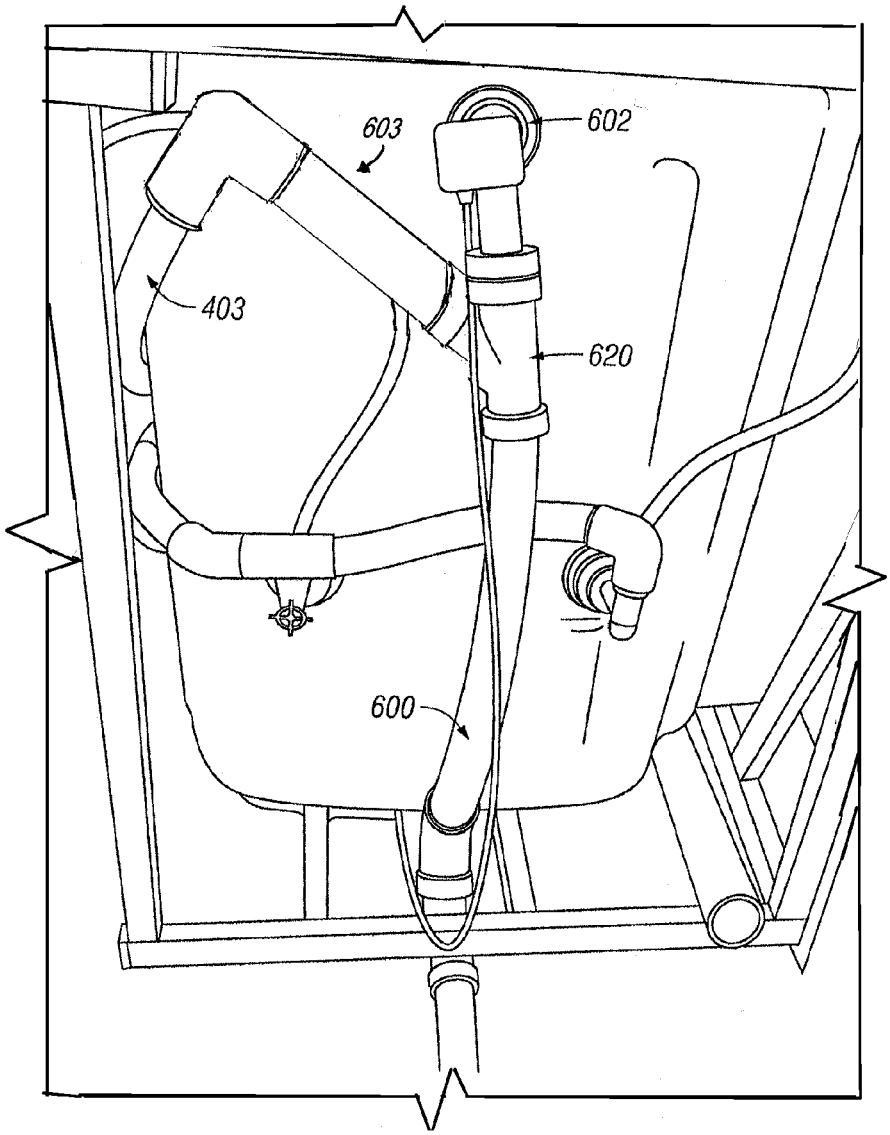
FIG. 6A shows the drain outlet assembly of the walk-in tub in accordance with a preferred embodiment of the present invention.
Figure 6B:
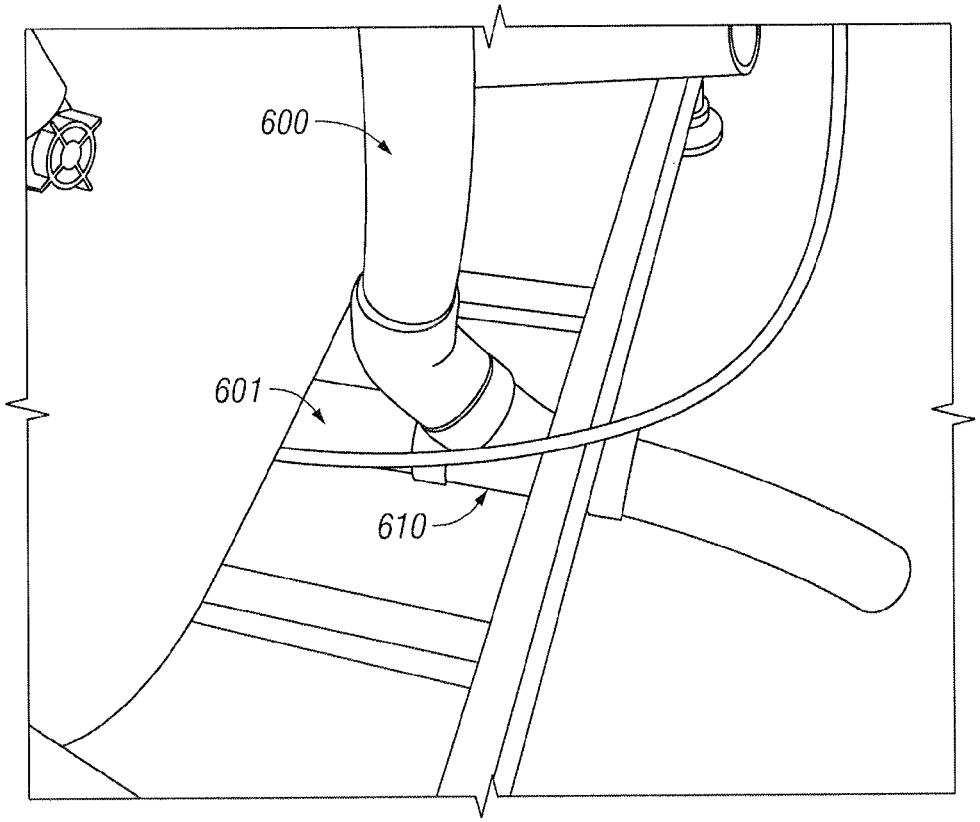
FIG. 6B shows a close-up perspective view of the lower drain pipe junction.

FIG. 6A shows the drain outlet assembly of the walk-in tub in accordance with a preferred embodiment of the present invention. FIG. 6B shows a close-up perspective view of the lower drain pipe junction. In one embodiment of the present invention the drain pipe configuration provides outlet paths for three sources of water.

The first outflow path is the hose 403 coming from the suction pump 402 described above. As show in FIG. 6A, the hose 403 bends upward above the overflow 602 and connects into a standard 1.5" pipe 603 which helps break the siphon. The transition from a 1" diameter to a 1.5" diameter creates an air pocket as the pipe size gets bigger. Without this air pocket, the entire line from the pump 402 to the primary drain pipe 600 would fill with water when the bathtub is filled causing the water to siphon out of the bath even if the conventional drain is closed and the pump 402 is not activated.

The 1.5" pipe drops down at approximately 45° to connect to the primary drain pipe 600 via a Y fitting 620 close to the overflow outlet 602. The downward 45° angle helps prevent backflow.

The second and most obvious outlet path is from the conventional gravity drain at the bottom of the tub foot well. As shown in FIG. 6B, this path is depicted by pipe 601 coming from the bottom of the tub and joining the primary drain pipe 600 via a Y joint 610. This connection creates a venturi effect that accelerates fluid flow and removes the water from the conventional pipe 601 faster.

The third water outflow path comes from the conventional overflow 602 near the top of the tub as shown in FIG. 6A.

Figure 7:
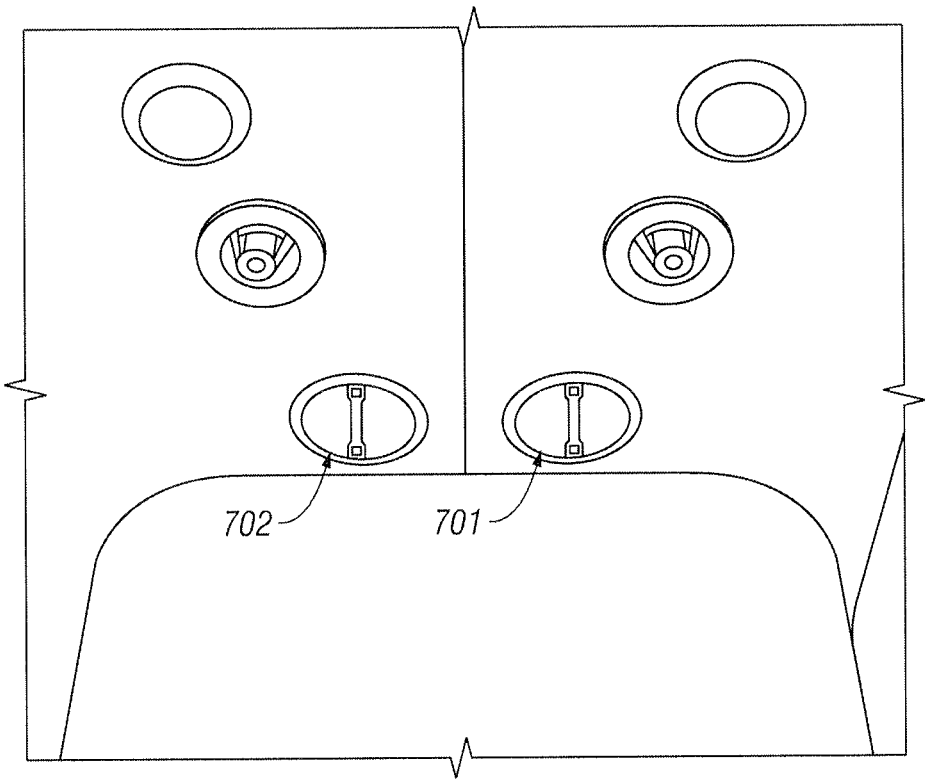
FIG. 7 shows the suction drain outlet in the foot well of the tub in accordance with the present invention.
Figure 8:
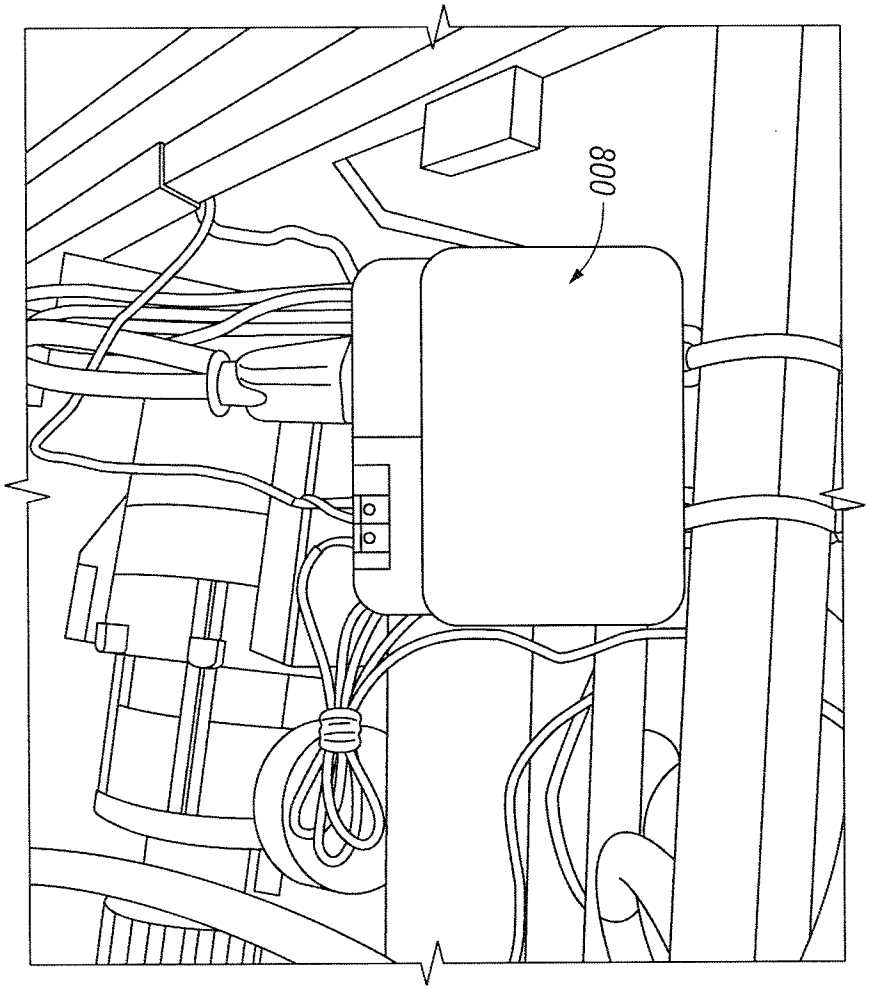
FIG. 8 shows a low water sensor in accordance with a preferred embodiment of the present invention.

FIG. 7 shows the suction drain outlet in the foot well of the tub in accordance with the present invention. In this embodiment, the suction drain outlet 701 is placed next to the return outlet 702 for the whirlpool pump. When the suction drain is activated by the user (via on/off button 210 shown in FIG. 2), the drain pump 402 begins pumping the water out through the drain outlet 701 in the foot well. As the water level reaches the opening of the suction outflow 701, a low water sensor shuts off the drain pump 402.

Figure 9:
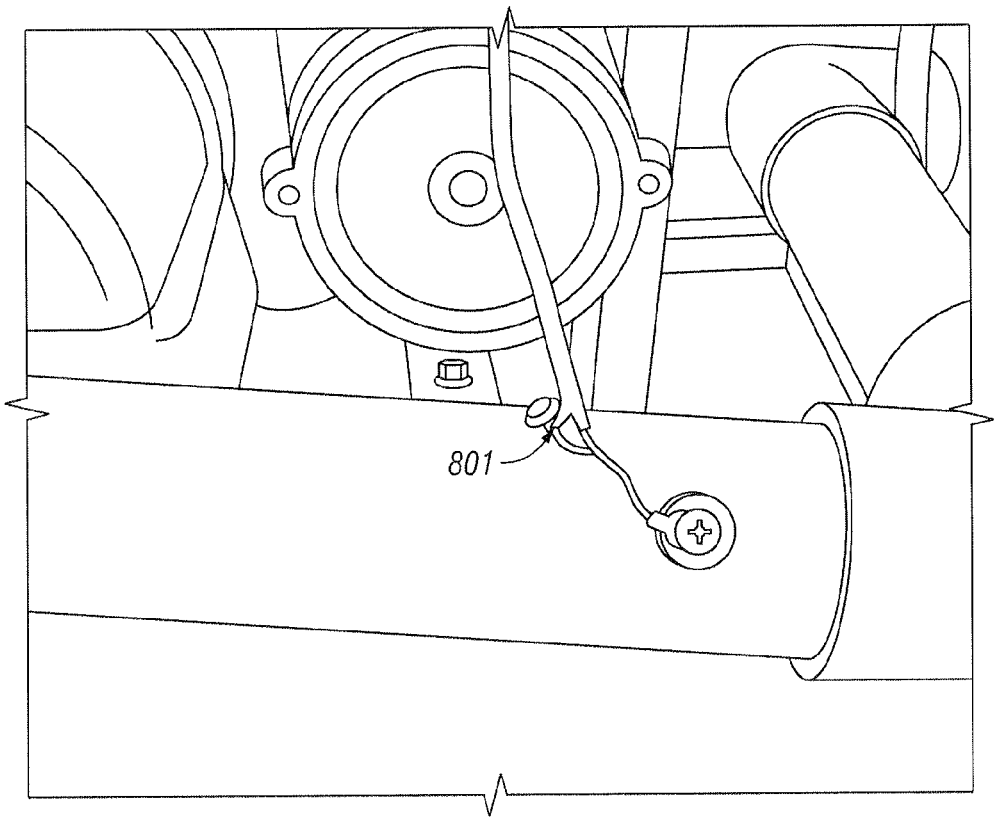
FIG. 9 shows a lead from the low water sensor to the suction pipe.

FIG. 9 shows the lower water sensor 800 in accordance with a preferred embodiment of the present invention. FIG. 9 shows a lead 801 from the low water sensor to the suction pipe 403. Because the suction outflow 701 is close to the bottom of the footwell most of the water has drained from the tub by the time the water level is even with the outflow opening. Switching off the drain pump at this point prevents air from being pumped through the system. The remainder of the water supply simply drains through the conventional drain opening at the bottom of the tub through pipe 601.

Using the figure described in the example above, the present invention can produce a drain rate of approximately 60 gpm. Using only a conventional gravity drain, a 60 gallon walk-in tub would take approximately seven minutes to drain. With the present invention, the same 60 gallon tub can drain in approximately one minute to the level where the suction pump switches off and only the conventional drain removes the remaining water, which is right at the level of the door threshold. At this point the user can open the door without the remaining water spilling out.

Different model tubs allow the suction to be set lower due to the radius of the wall (there needs to be a flat surface). Modification to tub molds can allow suction closer to the floor. In an alternate embodiment of the present invention, the drain in the floor of the bathtub is used as the suction outlet, eliminating the need for a separate outlet in the wall of the foot well.

The present invention is advantageous to the user not simply for convenience but also for health reasons. Because the user is sitting upright in the tub much of the body is exposed as the water drains from foot well of the tub. Several minutes of such exposure could pose a health risk for some individuals as they wait for the tub to drain, especially when one considers that many walk-in tub users already have preexisting conditions (hence their need for a walk-in tub). By reducing the drain time to about a minute, the present invention allows the user to drain the water and exit the tub with minimal exposure time before drying off.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

We claim:

1. A drain system for use with a walk-in bathtub, comprising:

(a) a motorized pump adapted to pump fluid out of an opening in a side of a foot well of a walk-in bathtub;

(b) a primary drain pipe for removing fluid from a walk-in bathtub;

(c) a first drain line for providing fluid outflow from a drain opening in a bottom of a walk-in bathtub to the primary drain pipe;

(d) a second drain line for providing fluid outflow from the motorized pump to the primary drain pipe, wherein the second drain pipe has a bend which sits higher than an overflow opening in a walk-in bathtub having the drain system; and (e) a low water sensor coupled to the second drain line and motorized pump, wherein the low water sensor is able to deactivate the motorized pump when a fluid level in a walk-in bathtub having the drain system is equal to or lower than a drain opening in a side of a foot well in a walk-in bathtub.

2. The drain system according to claim 1, further comprising:

(f) a third drain line for providing fluid outflow from an overflow opening at a top of a walk-in bathtub to the primary drain pipe for preventing water from overflowing a walk-in bathtub.

3. The drain system according to claim 2, wherein the second drain line and the third drain line connect to the primary drain pipe through a Y joint, wherein the bend in the second drain line is for preventing backflow from an overflow opening through the second drain line and bends downward at approximately 45 degrees relative to the horizontal to join the Y joint.

4. The drain system according to claim 3, wherein the second drain line comprises: a 1 inch hose; and a 1.5 inch pipe; wherein the 1 inch hose leads from the drain pump to the 1.5 inch pipe, and the 1.5 pipe inserts into the Y joint; and wherein a junction between the 1 inch hose and 1.5 inch pipe forms the bend in the second drain line so as to be above an overflow opening in a walk-in bathtub having the drain system and prevents siphoning through the second drain line when the drain pump is not activated.

5. The drain system according to claim 1, wherein the drain system produces a fluid outflow rate from a walk-in bathtub having the drain system of 60 gallons per minute.

6. A drain system for a walk-in bathtub, comprising:

(a) a motorized pump adapted to pump fluid out of a drain opening in a foot well of a walk-in bathtub;

(b) a primary drain pipe;

(c) a drain line for providing fluid outflow from the motorized pump to the primary drain pipe, wherein the drain line includes a hose and a second pipe, wherein the hose leads from the motorized pump to the second pipe and the second pipe connects to the primary drain pipe via a Y joint, wherein the second pipe has a larger diameter than the hose and a junction between the hose and second pipe creates an air pocket that prevents siphoning through the drain line when the motorized pump is not activated and the junction of the hose and the second pipe has a bend which sits higher than an overflow opening in a walk-in bathtub having the drain system; and (d) a low water sensor coupled to the drain line and motorized pump, wherein the low water sensor is able to deactivate the motorized pump when a fluid level in a walk-in bathtub having the drain system is equal to or lower than a drain opening in a foot well of the walk-in bathtub.

7. The drain system according to claim 6, wherein the primary drain pipe is also for connecting to an overflow opening at a top of a walk-in bathtub having the drain system via the Y joint, wherein the drain line bends downward at approximately 45 degrees to join the Y joint, wherein the bend in the drain line is formed by the junction of the hose and the second pipe and can prevent backflow from an overflow opening in a walk-in bathtub having the drain system.

8. The drain system according to claim 1, wherein the first drain line connects to the primary drain pipe through a Y joint, wherein the Y joint accelerates water outflow.

9. A drain system comprising:

(a) a motorized pump adapted to pump fluid through a second bathtub drain opening;

(b) a primary drain pipe;

(c) a first drain line for providing fluid outflow from a first bathtub drain opening to the primary drain pipe; and (d) a second drain line for providing fluid outflow from the motorized pump to the primary drain pipe, wherein the second drain line has a bend which sits higher than an overflow opening in a walk-in tub having the drain system.

10. The drain system according to claim 9, further comprising a low water sensor coupled to the second drain line and the motorized pump, wherein the low water sensor is able to deactivate the motorized pump when a fluid level in a bathtub is equal to or lower than the second drain opening.

11. The drain system according to claim 9, further comprising a third drain line for providing fluid outflow from a bathtub overflow opening to the primary drain pipe.

12. The drain system according to claim 11, wherein the second drain line and said third drain line connect to the primary drain pipe through a Y joint, wherein the second drain line bends downward at approximately 45 degrees relative to the horizontal to join the Y joint, wherein the bend in the second drain line prevents backflow from a bathtub overflow opening through the second drain line for a bathtub having the drain system.

13. The drain system according to claim 12, wherein the second drain line comprises: a 1 inch hose; and a 1.5 inch pipe; wherein said 1 inch hose leads from the motorized pump to the 1.5 inch pipe, and the 1.5 pipe inserts into the Y joint; and wherein a junction between the 1 inch hose and 1.5 inch pipe forms the bend in the second drain line and prevents siphoning through the second drain line when the drain pump is not activated.

14. The drain system according to claim 9, wherein the drain system produces a fluid outflow rate from a bathtub having the drain system of 60 gallons per minute.

15. A walk-in bathtub having a drain system, comprising (a) a walk-in bathtub having a tub having side walls with a door through at least one of the side walls, and a tub bottom, wherein the tub has a foot well and a seat, wherein the tub has a drain opening capable of removing fluid from the tub and an upper overflow opening in one of the side walls of the tub; and (b) a drain system comprising:

(i) a motorized pump for pumping water through the drain opening;

(ii) a primary drain pipe; and (iii) a drain line for providing fluid outflow from the motorized pump to the primary drain pipe, wherein the drain line has a bend and a top of the bend is higher than the upper overflow opening of the tub, the upper overflow opening of the walk-in bathtub is in fluid communication with the primary drain pipe through an overflow drain line and the tub drain opening capable of removing fluid from the tub is also in fluid communication with the primary drain pipe.

16. The walk-in bathtub according to claim 15, wherein the drain system is configured so that flow from the drain line for providing fluid outflow from the motorized pump and flow from the overflow drain line combine prior to entering the primary drain pipe.

17. The walk-in bathtub according to claim 15, wherein the drain line for providing fluid outflow from the motorized pump to the primary drain line has a first hose extending from the motorized pump to the bend and a second pipe extending from the bend to the primary drain pipe, wherein the hose and the second pipe are joined at the bend and the second pipe has a diameter greater than a diameter of the hose.

18. The walk-in bathtub according to claim 15, wherein the drain opening for removing fluid from the tub is in one of the side walls within the foot well and the tub comprises (iv)

another drain opening in the bottom of the tub, and (v) a low water sensor coupled to the motorized pump and the drain line from the motorized pump, wherein when a water level in the walk-in bathtub is at or lower than the drain opening in the side wall of the foot well, the sensor operates to deactivate the motorized pump.

19. The walk-in bathtub according to claim 15, wherein the drain system is able to produce a water outflow rate of 60 gallons per minute.

20. A walk-in bathtub having a drain system, comprising (a) a walk-in bathtub having a tub having side walls with a door through at least one of the side walls, and a tub bottom, wherein the tub has a foot well and a seat, wherein the tub has a first drain opening in one of the side walls in the foot well of the tub capable of removing fluid from the tub, an opening in the bottom of the tub and an upper overflow opening in one of the side walls of the tub; and (b) a drain system comprising:

(i) a motorized pump for pumping water through the drain opening;

(ii) a primary drain pipe;

(iii) a first drain line for providing fluid outflow from the opening in the bottom of the tub to the primary drain pipe; and (iv) a second drain line for providing fluid outflow from the motorized pump to the primary drain pipe, wherein the drain line has a bend and a top of the bend is higher than the upper overflow opening of the tub and the overflow opening is in fluid communication with the primary drain pipe.

21. The walk-in bathtub according to claim 20, wherein the upper overflow opening of the walk-in bathtub is in fluid communication with the primary drain pipe through a third overflow drain line.

22. The walk-in bathtub according to claim 21, wherein the second drain line from the motorized pump joins with the third overflow drain line such that flow through the second drain line from the motorized pump and flow through the third overflow drain line from the overflow opening combine to enter the primary drain pipe.

23. The walk-in bathtub according to claim 20, further comprising a low water sensor coupled to the motorized pump and the second drain line, wherein when a water level in the walk-in bathtub is at or lower than the first drain opening in the side wall of the foot well, the sensor operates to deactivate the motorized pump.

24. The walk-in bathtub according to claim 20, wherein the drain system is able to produce a water outflow rate of 60 gallons per minute.

25. A bathtub having a drain system, comprising (a) a bathtub having a tub having side walls and a tub bottom, wherein the tub a drain opening capable of removing fluid from the tub and an upper overflow opening in one of the side walls of the tub; and (b) a drain system comprising:

(i) a motorized pump for pumping water through the drain opening;

(ii) a primary drain pipe; and (iii) a drain line for providing fluid outflow from the motorized pump to the primary drain pipe, wherein the drain line has a bend and a top of the bend is higher than the upper overflow opening of the tub and the upper overflow opening of the tub is in fluid communication with the primary drain pipe.

26. A bathtub having a drain system, comprising (a) a bathtub having a tub having side walls and a tub bottom, wherein the tub has a first drain opening in one of the side walls of the tub capable of removing fluid from the tub, an opening in the bottom of the tub and an upper overflow opening in one of the side walls of the tub; and (b) a drain system comprising:

(i) a motorized pump for pumping water through the drain opening;

(ii) a primary drain pipe;

(iii) a first drain line for providing fluid outflow from the opening in the bottom of the tub to the primary drain pipe; and (iv) a second drain line for providing fluid outflow from the motorized pump to the primary drain pipe, wherein the drain line has a bend and a top of the bend is higher than the upper overflow opening of the tub and the upper overflow opening is in fluid communication with the primary drain pipe.

27. A walk-in bathtub having a drain system, comprising (a) a walk-in bathtub having a tub having side walls with a door through at least one of the side walls, and a tub bottom, wherein the tub has a foot well and a seat, wherein the tub has a drain opening capable of removing fluid from the tub and an upper overflow opening in one of the side walls of the tub; and (b) a drain system comprising:

(i) a motorized pump for pumping water through the drain opening;

(ii) a primary drain pipe; and (iii) a drain line for providing fluid outflow from the motorized pump to the primary drain pipe, wherein the drain line has a bend and is configured to prevent water in the tub from siphoning out of the bath when the drain opening capable of removing fluid from the tub is closed and/or the pump is off, and wherein the tub drain opening capable of removing fluid from the tub is also in fluid communication with the primary drain pipe.

28. The walk-in bathtub according to claim 27, the upper overflow opening of the walk-in bathtub is in fluid communication with the primary drain pipe through an overflow drain line and the drain system is configured so that flow from the drain line for providing fluid outflow from the motorized pump and flow from the overflow drain line combine prior to entering the primary drain pipe.

29. The walk-in bathtub according to claim 28, wherein the bend sits higher than the overflow opening of the tub.

30. The walk-in bathtub according to claim 27, wherein the drain line for providing fluid outflow from the motorized pump to the primary drain line has a first hose extending from the motorized pump to the bend and a second pipe extending from the bend to the primary drain pipe, wherein the hose and the second pipe are joined at the bend and the second pipe has a diameter greater than a diameter of the hose.

31. The walk-in bathtub according to claim 27, wherein the drain opening for removing fluid from the tub is in one of the side walls within the foot well and the tub comprises (iv) another drain opening in the bottom of the tub, and (v) a low water sensor coupled to the motorized pump and the drain line from the motorized pump, wherein when a water level in the walk-in bathtub is at or lower than the drain opening in the side wall of the foot well, the sensor operates to deactivate the motorized pump.

32. The walk-in bathtub according to claim 27, wherein the drain system is able to produce a water outflow rate of 60 gallons per minute.

33. A walk-in bathtub having a drain system, comprising (a) a walk-in bathtub having a tub having side walls with a door through at least one of the side walls, and a tub bottom, wherein the tub has a foot well and a seat, wherein the tub has a first drain opening in one of the side walls in the foot well of the tub capable of removing fluid from the tub, an opening in the bottom of the tub and an upper overflow opening in one of the side walls of the tub; and (b) a drain system comprising:

(i) a motorized pump for pumping water through the drain opening;

(ii) a primary drain pipe;

(iii) a first drain line for providing fluid outflow from the opening in the bottom of the tub to the primary drain pipe; and (iv) a second drain line for providing fluid outflow from the motorized pump to the primary drain pipe, wherein the drain line has a bend, and the bend and is configured to prevent water in the tub from siphoning out of the bath when the drain opening capable of removing fluid from the tub is closed and/or the pump is off.

34. The walk-in bathtub according to claim 33, wherein the upper overflow opening of the walk-in bathtub is in fluid communication with the primary drain pipe through a third overflow drain line.

35. The walk-in bathtub according to claim 34, wherein the second drain line from the motorized pump joins with the third overflow drain line such that flow through the second drain line from the motorized pump and flow through the third overflow drain line from the overflow opening combine to enter the primary drain pipe.

36. The walk-in bathtub according to claim 34, wherein the bend sits higher than the overflow opening of the tub.

37. The walk-in bathtub according to claim 33, further comprising a low water sensor coupled to the motorized pump and the second drain line, wherein when a water level in the walk-in bathtub is at or lower than the first drain opening in the side wall of the foot well, the sensor operates to deactivate the motorized pump.

38. The walk-in bathtub according to claim 34, wherein the drain system is able to produce a water outflow rate of 60 gallons per minute.

39. A bathtub having a drain system, comprising (a) a bathtub having a tub having side walls and a tub bottom, wherein the tub a drain opening capable of removing fluid from the tub and an upper overflow opening in one of the side walls of the tub; and (b) a drain system comprising:

(i) a motorized pump for pumping water through the drain opening;

(ii) a primary drain pipe; and (iii) a drain line for providing fluid outflow from the motorized pump to the primary drain pipe, wherein the drain line has a bend and the bend and is configured to prevent water in the tub from siphoning out of the bath when the drain opening capable of removing fluid from the tub is closed and/or the pump is off.

40. A bathtub having a drain system, comprising (a) a bathtub having a tub having side walls and a tub bottom, wherein the tub has a first drain opening in one of the side walls of the tub capable of removing fluid from the tub, an opening in the bottom of the tub and an upper overflow opening in one of the side walls of the tub; and (b) a drain system comprising:

(i) a motorized pump for pumping water through the drain opening;

(ii) a primary drain pipe;

(iii) a first drain line for providing fluid outflow from the opening in the bottom of the tub to the primary drain pipe; and (iv) a second drain line for providing fluid outflow from the motorized pump to the primary drain pipe, wherein the second drain line has a bend, and the bend and is configured to prevent water in the tub from siphoning out of the bath when the drain opening capable of removing fluid from the tub is closed and/or the pump is off.

41. A drain system for use with a walk-in bathtub, comprising:

(a) a motorized pump adapted to pump fluid out of a drain opening in a walk-in bathtub;

(b) a primary drain pipe for removing fluid from a walk-in bathtub;

(c) a first drain line for providing fluid outflow from a drain opening of a walk-in bathtub to the primary drain pipe;

(d) a second drain line for providing fluid outflow from the motorized pump to the primary drain pipe, wherein the second drain pipe has a bend; and (e) a third drain line for providing fluid outflow from an overflow opening in a walk-in bathtub; wherein the drain system is configured so that flow from the second drain line and flow from the third drain line combine prior to entering the primary drain line.

42. The drain system for use with a walk-in bathtub according to claim 41, further comprising a low water sensor coupled to the second drain line and the motorized pump, wherein the low water sensor is able to deactivate the motorized pump when a fluid level in a walk-in bathtub having the drain system is equal to or lower than a drain opening in the side of a foot well in the walk-in bathtub.

43. The drain system for use with a walk-in bathtub according to claim 41, wherein the bend of the second drain line is configured to sit higher than an overflow opening in a walk-in bathtub having the drain system.

44. The drain system for use with a walk-in bathtub according to claim 41, wherein the bend and is configured to prevent water in a walk-in bathtub having the drain system from siphoning out of the walk-in bathtub when a drain opening capable of removing fluid from the tub through the first drain line is closed and/or the motorized pump is off.

* * * * *